United States Patent [19]

Hazelett, Jr.

[11] 3,996,714

[45] Dec. 14, 1976

[54] PANEL WALL STRUCTURE

[76] Inventor: Earl T. Hazelett, Jr., P.O. Box 342, Gunnison, Colo. 81230

[22] Filed: Aug. 11, 1975

[21] Appl. No.: 603,331

[52] U.S. Cl. ..... 52/367; 52/494; 52/583; 52/585

[51] Int. Cl.[2] ..... E04B 2/00; E04B 5/52

[58] Field of Search ..... 52/367, 474, 494, 758 B, 52/660, 601, 583, 585, 656, 578

[56] References Cited

UNITED STATES PATENTS

| | | | |
|---|---|---|---|
| 1,031,926 | 7/1912 | Hansbrough | 52/660 |
| 2,238,355 | 4/1941 | Whitenack | 52/656 |
| 3,228,161 | 1/1963 | McCown | 52/758 B |
| 3,594,971 | 7/1971 | Hughes | 52/585 |
| 3,817,014 | 6/1974 | Jones | 52/494 |
| R23,153 | 10/1949 | Kautz | 52/507 |

*Primary Examiner*—Price C. Faw, Jr.
*Assistant Examiner*—Robert C. Farber

[57] ABSTRACT

A panel wall structure comprising cast concrete panels each panel having an outline frame provided with inwardly diverging cross section in which the concrete is cast and held in anchored position. The outline frame being formed of generally L-shaped in cross section metal members whereby one of these members may be nested in a generally conforming metal member cast in a concrete foundation and the metal member of the panel being welded to the metal member anchored in the concrete foundation, the normally upper portion of the outline frame of the panel adapted to support a conforming downwardly diverging third member which carries a top plate and the metal member cast in the foundation supporting a floor plate; and a wall panel nailed to the top and floor plates aforementioned.

2 Claims, 9 Drawing Figures

FIG.2.
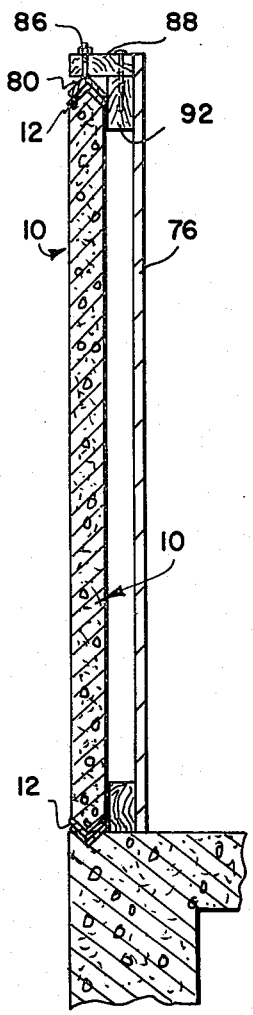
FIG.1.
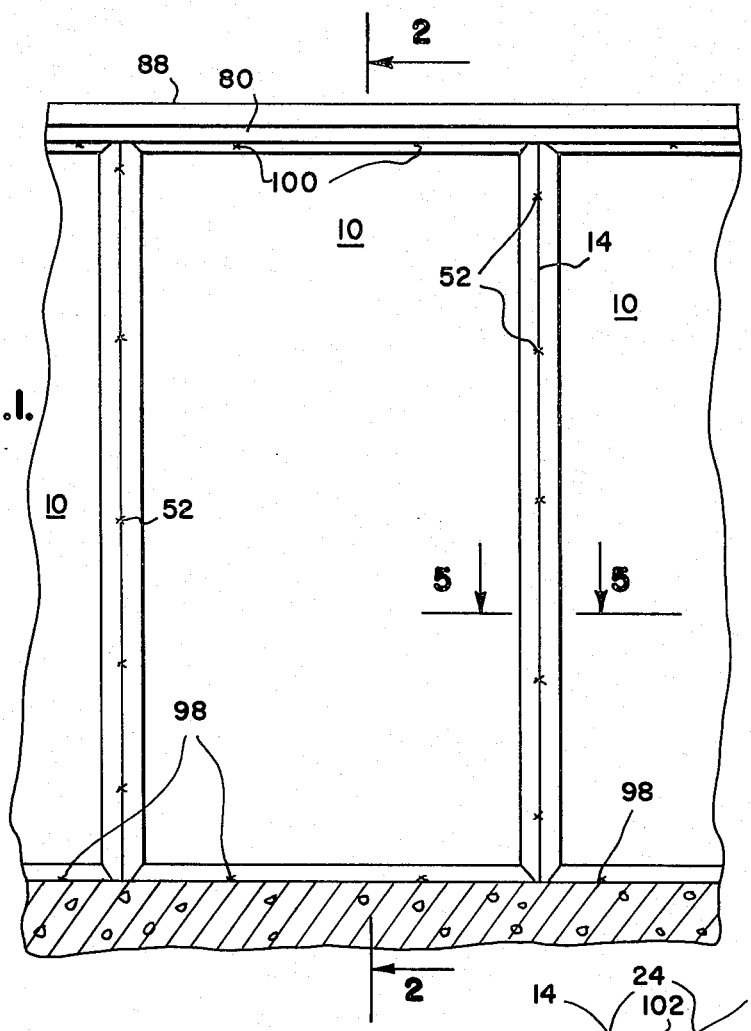
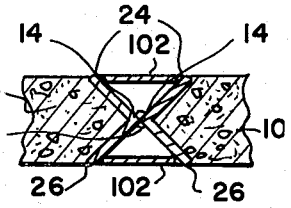
FIG.5.
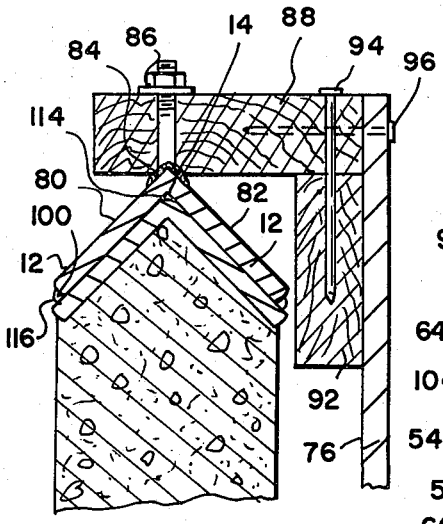
FIG.3.
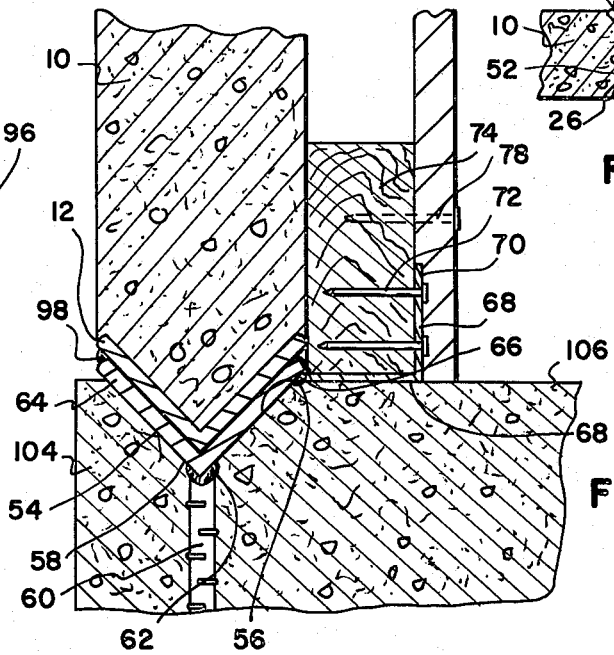
FIG.4.

PANEL WALL STRUCTURE

BACKGROUND OF THE INVENTION

Various prior art panel wall structures have been costly to produce due to expensive forms that are normally required for producing panels of concrete or other material and additionally, suitable means for assembling and securing together a plurality of panels to form a wall structure in combination with a foundation.

Heretofore the various fixtures and devices used for securing panels to foundations have been relatively expensive either in materials of labor or have required various fixtures which have been unsatisfactory in securing the wall panels to the foundation in such a manner that they are weather proof and also structurally adequate. Furthermore, various difficulties have been encountered in the integration of concrete panels to internal walls due to the fact that various means for securing floor plates and top plates to concrete wall panels have been somewhat complex, expensive or structurally unsatisfactory.

SUMMARY OF THE INVENTION

The present invention relates to a panel wall structure wherein a novel cast panel is provided with an outline frame having outwardly converging cross section and inwardly diverging cross section, the members of the outline frame generally forming a rectangular structure retaining the concrete cast therein which is anchored in the outwardly converging portions of the outline frame. The outwardly converging portions of the outline frame next in conforming structure cast in a concrete foundation, the conforming structure and the outline frame both being of metal and thereby providing means by which the outline frame of the panel may be welded to the metal member cast in the concrete foundation. These members are preferably L-shaped wherein the metal member in the foundation is provided with upwardly diverging walls with oppositely directed edges extending therefrom, the cross section of the metal members of the outline frame of the panel being similar such that the outwardly converging surfaces of the outline frame next in the upwardly diverging structure of the metal member cast in the foundation secured to the metal member cast in the foundation is a generally L-shaped clip to which a wooden floor plate member is nailed and the normally upper edge of the panel is nested at its outwardly converging portions between downwardly diverging portions of the third metal member similar in cross section to the outline frame structure and the metal member cast in the concrete foundation. The third metal member is provided with an upwardly directed bolt secured to a top plate structure and a wall panel is nailed to the top plate structure and bottom plate structure both of which are made of wood and the wall panel is thus supported at the inner side of the concrete panel of the wall structure.

The metal member in the foundation is anchored by a suitable piece of rebar or other material at properly spaced locations longitudinally of the metal member cast in the foundation.

It will be understood that the conforming diverging and converging structures of the base metal member in the foundation and that of the panel respectively provide for good structural support and lateral support of the panel relative to the foundation and also provides means by which mastic may be entrapped in the channel structures for sealing the lower edges of the panels relative to the foundation and also it will be apparent that the metal member of the outline frame of the panel may be welded to the metal member in the concrete foundation such as to maintain the nested relationship of the two members at the juncture of the building wall and floor or foundation structure. The invention has particular advantages in the construction of various walls such as buildings or the like and the panels themselves when cast required no forms since the outline frame provides the form and also provides for means for handling the panel without difficulty and with complete protection to the concrete structure of the panel. The light weight of the panel together with its rigid outline frame is adapted to various buildings and the frame as well as the concrete cast therein and the manner in which the structure is secured to a floor provides for very substantial load bearing capabilities for carrying the roof as well as wind pressures and other requirements which must be met in accordance with the conventional building codes. The panels may be made in modular sizes as desired and the panel wall construction of the invention has many advantages due to the fact that the steel channel outline frame of each panel completely surrounds the panel and protects the concrete material therein. Additionally, this panel structure using the outline frame provides a very simple and inexpensive way of reinforcing a concrete panel to attain maximum strength and minimum breakage. Additionally, the panel wall construction of the invention provides a rapid, easy method by means of welding for securely fastening concrete panels together and/or to steel framework and also through use of metal clips to woodwork and also the foundation of the building or to the floor structure thereof as desired.

The construction of the panel of the invention relative to the metal members cast in the foundation of a building provides for easy caulking of a fine joint line between the foundation as well as between the panels there providing weather proofed construction and the construction also permits the use of a narrow, flat metal strip over the panel joints which strip may be spot welded into position thereover. Additionally, the panel wall structure of the invention provides a strong light weight structural concrete panel that will carry roof loading, withstand wind pressure and various other construction requirements and is not easily damaged in handling and can be used generally in the construction of many structures in a very inexpensive manner. Further the outline frame of the panel of the invention eliminates the necessity of using expensive forms in the pouring of the concrete panels since the steel channel outline frame serves as the sides of the form and becomes an integral part of the channel when finished to protect it, reinforce it and to generally provide the strength for handling and structural requirements when in place.

Accordingly, it is an object of the invention to provide a very simple, economical and durable panel wall structure having all of the foregoing advantages.

Another object of the invention is to provide a novel means for securing concrete wall panels to a foundation as well as to a floor plate and a top plate for supporting an internal wall panel.

Another object of the invention is to provide a novel building panel structure.

Another object of the invention is to provide novel means for casting a generally L-shaped member in a foundation and for securing wall panels of the invention together and for covering the joint portion thereof.

Another object of the invention is to provide a novel outline frame construction for concrete panels.

Another object of the invention is to provide a very substantial panel wall structure having novel means for securing panels to a foundation and means for sealing the panels against the elements at the joinder thereof with the foundation.

Further objects and advantages of the invention may be apparent from the following specification, appended claims and accompanying drawings.

BRIEF DESCRIPTION OF THE DRAWINGS

FIG. 1 is a fragmentary side elevational view of a panel wall structure of the invention showing several panels of the invention secured to a foundation and supporting a top plate structure in connection therewith;

FIG. 2 is a vertical sectional view taken from the line 2—2 of FIG. 1;

FIG. 3 is a fragmentary enlarged sectional view similar to FIG. 2 and showing a portion of FIG. 2 at its upper area on an enlarged scale;

FIG. 4 is an enlarged fragmentary view similar to the lower end of FIG. 2;

FIG. 5 is a horizontal sectional view taken from the line 5—5 of FIG. 1 showing the structure thereof on an enlarged scale;

DESCRIPTION OF THE PREFERRED EMBODIMENTS

Figure 6:
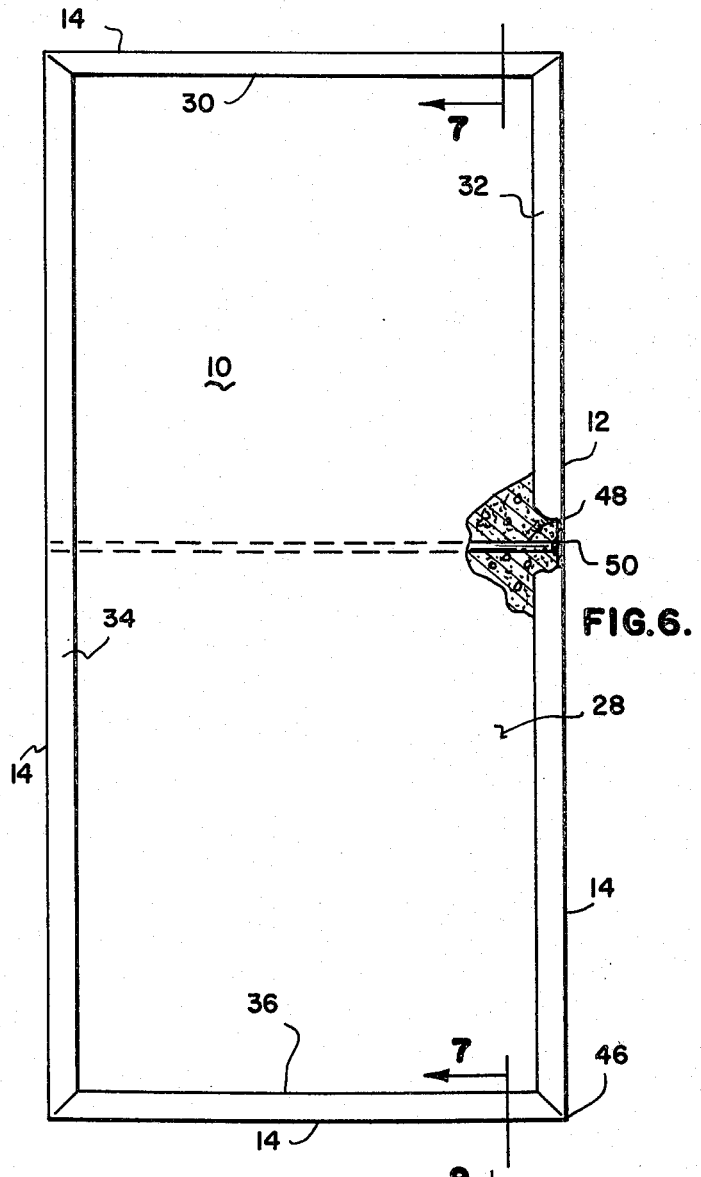
FIG. 6 is a side elevational view of a panel structure of the invention showing portions thereof broken away and in section to amplify the illustration.

While the invention relates generally to a panel wall structure it will be obvious that as the description of the invention continues that the panels of the invention as shown in FIG. 6 are not only adapted for use in connection with the construction of walls but also for use in constructing roof decking, floor decking, sidewalks, balcony railings, mobile home skirts and other structures requiring horizontal or vertical enclosure or support structure.

Figure 7:
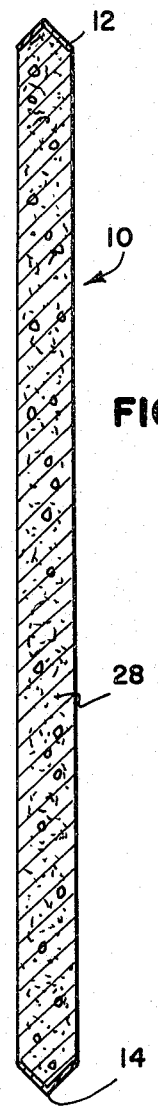
FIG. 7 is a vertical sectional view taken from the line 7—7 of FIG. 6.
Figure 8:
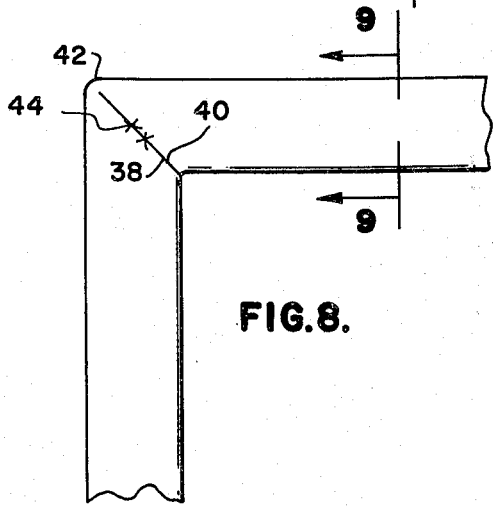
FIG. 8 is an enlarged fragmentary view of a corner structure of the outline frame of the panel shown in FIG. 6.
Figure 9:
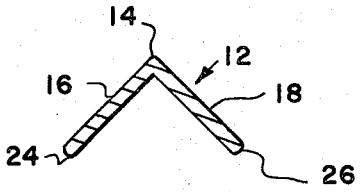
FIG. 9 is a cross sectional view taken from the line 9—9 of FIG. 8 showing a cross section of the outline frame members of the panel of the invention.

As shown in FIGS. 1, 6 and 7 of the drawings, the invention comprises panels 10, each of which is provided with an outline frame 12; the outline rame 12 being made of metal and having cross section as shown best in FIG. 9 wherein the metal members of the frame on all four sides are generally L-shaped in cross section, each metal member having an intermediate web portion 14 provided with integral relatively diverging wall portions 16 and 18 which have opposite edges 24 and 26.

Concrete 28 is cast within the confines of the outline frame which comprises metal portions or members 30, 32, 34, and 36 as shown in FIG. 6 of the drawings. All of these frame portions or members has a cross section similar to that shown in FIG. 9 and the outer portions of the cross section as shown in FIG. 9 are such that the walls 16 and 18 converge outwardly at the outer portions of the panel and diverge inwardly toward the concrete 28 by holding the concrete captive between the inwardly converging portions of the walls 16 and 18.

At the corners of the panels 10 the L-shaped cross sectional structure shown in FIG. 9 is mitered at 38 and 40, each corner being designated 42 at which the miters occur and these miter cuts are at substantially 45 degrees each so as to provide a 90 degree corner and the adjacent edges may be welded together at 44 so as to provide a very stiff outline frame which may be composed of a single piece of metal and may be joined and welded at 46 for example as shown in FIG. 6 of the drawings.

A reinforcing tension rod 48 may be welded to the inner portion of the respective web portions 14 thus securing opposite side portions 32 and 34 of the outline frame together, the reinforcing rod being welded at 50 to the outline frame member 32 at its apex portion 14 and to a respective portion of the outline frame member 34 at the opposite end of the reinforcing member 48.

As shown in FIG. 1 of the drawings, adjacent apex portions 14 are welded together at 52 and lower most portions 14 of the outline frames 12 as shown in FIG. 4 are disposed between adjacent upwardly diverging walls 54 and 56 of an L-shaped in cross section metal member 58 which is similar in cross section to the outline frame member 12 as shown in FIG. 9 of the drawings.

The member 58 is provided with an anchor 60 welded to the web portions 62 of the said metal member 54 and integral with the upwardly diverging walls 54 and 56 are edges 64 and 66, welded to the edge 66 is an L-shaped clip 68 which has an upstanding portion 70 provided with holes through which nails 72 are driven into a floor plate 74 and a wall panel 76 such as a panel of sheetrock of the like is nailed to the floor plate member 74 by means of nails 78. It will be understood that the floor plate 74 is preferably made of wood.

As shown in detail in FIG. 3 of the drawings, the upper portion of the frame 12 of the panel 10 shown in FIG. 2 of the drawings has its apex portion 14 disposed between downwardly diverging walls 80 and 82 of a third metal member having the same cross section as shown in FIG. 9 of the drawings. Fixed to the third metal member at its apex position 84 is a bolt 86 which passes through and secures a top plate member 88 to the web portion 84. Secured to this top plate member 88 is the wall panel 76 thus the upper end of the wall panel 76 is supported in connection with the top plate 88 while its lower portion is supported in connection with the bottom plate or floor plate 74.

This top plate 88 is a wooden member and may be extended by means of nails 94 which secure another wooden member 92 thereto. The wall panel 76 being an interior wall panel is secured by nails 96 to the top plate member 88 and further nails may be driven therethrough into the wooden member 92.

The interior wall panel 76 may be sheetrock or other suitable material such as plywood as desired.

It will be seen that the outline frame 12 shown in FIG. 4 of the drawings is secured to the metal member 54 by means of a spot weld 98, these spot welds 98 may be spaced a shown in FIG. 1 of the drawings and the upper portion of the outline frame 12 may be secured by means of spot welds 100 to the third metal member 80 all as shown best in FIGS. 1 and 3 of the drawings.

As shown in FIG. 5 of the drawings adjacent web portions 14 of the outline frames of the panels 10 may be covered by metal strips 102 welded to the respective edges 24 and 26 all as shown in FIG. 5 of the drawings. Thus the thin metal strips 102 provide for a flush condition of the assembly of the panels which may apply both in the vertical or horizontal positions as wall panels, floor decking or roof decking as desired.

The nesting of the outline frame of each panel in the upwardly diverging walls 54 and 56 of the metal member 58 as shown in FIG. 4 provides a very secure lateral support and alignment for the wall panels of the invention and the securement of the floor plate 74 and top plate 88 in the manner hereinbefore described provides a very simple and economical and very structurally satisfactory means by which interior wall panel 76 may be secured in spaced relation to the inner wall structure or surface of each and all of the concrete panels 10.

The foundation 104 is cast with the metal member 58 and its anchor member 60 therein such that the edges 64 and 66 may be substantially flush with the upper surface 106 of the foundation 104 or the edges 64 and 66 may be above the upper surface slightly if desired.

The L-shaped member 68 being welded to the edge 66 shown in FIG. 4 provides for a very precise and secure means by which the interior wall panel 76 may be connected with concrete and steel structures of the floor and walls of the panel wall structure of the invention.

The outline frame 12 of each panel as hereinbefore described in connection with FIGS. 6 to 9 of the drawings provides a means by which the panel may be cast such that the concrete is substantially flush with the edges 24 and 26 of each outline frame member and whereby when the panel is finished and the concrete is set that the entire periphery of the panel is protected by the steel members to prevent damage thereto and also the insure safe transportation of the panel without any cracking thereof. It will be understood that during transportation of the panels of the invention the outline frame protects all features of the panels and provides for easy handling of the panels and rapid handling of the panels without special handling equipment. Accordingly, the construction of wall or other structures by means of the invention is greatly facilitated and may be rapidly done without concern for damaging the panels and due to the fact that the outline frame is steel it may be readily and quickly welded into place, all of which facilitates and promotes the rapid construction of buildings in accordance with the invention.

Mastic is preferably inserted in the areas designated 110 and 112 in FIG. 4 of the drawings to thereby efficiently seal the juncture of the wall panels relative to the foundation and to thereby prevent leakage of the elements between the wall panels and the foundation. Additionally, mastic may be provied at the joinders of the web portions 14 in the vertical areas between the panels and behind the metal members 102 shown in FIG. 5 of the drawings. Accordingly, it will be appreciated that a very efficient weather type seal may be accomplished when the construction of the invention is completed. Furthermore, mastic may be positioned between the metal member 80 and the upper portion of the outline frame 12 in areas designated 114 and 116 in FIG. 3 of the drawings. Thus mastic in these areas will prevent the leakage of water in and around and between the top plate supporting member 80 and the upper edge of the respective panel. Additionally, mastic may be positioned between the top plate 88 and the web 84 of the metal member of which the converging portions 80 and 82 are a part.

From the foregoing it will be understood that the construction of a panel wall structure in accordance with the invention is very simple and that this structure may be adapted to roof decking, floor decking, etc. Considering the plates 102 shown in FIG. 5, it will be appreciated that a flush wall, floor or roof decking may be provided and that suitable covering may be utilized as desired for the particular purposes intended.

It will be seen that the vertically disposed portions of the outline frame 12 being welded together at 52 provide very substantial columns which may not only retain the concrete structure of each and all of the panels but also provide a vertical as well as horizontal load bearing structure of very substantial capabilities to carry roof loading as well as wind loading, etc.

It will be obvious to those skilled in the art that various modifications may be resorted to without departing from the spirit of the invention.

I claim:

1. A wall panel having an outline frame provided with inwardly diverging and outwardly converging cross section; concrete cast in said outline frame and anchored in said inwardly diverging portions of said outline frame; said outline frame having opposite sides, the diverging portions of said opposite sides of said frame divergingly directed toward each other; at least one cross member extending through said concrete and welded to opposite sides of said frame.

2. The invention as defined in claim 1, wherein: said outline frame cross section comprises a generally L-shaped sectional structure having an apex with integral diverging walls and each of said walls having an edge; the edges of said walls being at opposite sides of said panel from each other.

* * * * *